United States Patent [19]

Kempter et al.

[11] 4,186,075

[45] Jan. 29, 1980

[54] ANODE FOR CATHODIC ELECTROCOATING

[75] Inventors: Fritz E. Kempter, Mannheim; Klaus Boehlke, Ludwigshafen, both of Fed. Rep. of Germany

[73] Assignee: BASF Aktiengesellschaft, Fed. Rep. of Germany

[21] Appl. No.: 929,033

[22] Filed: Jul. 28, 1978

Related U.S. Application Data

[63] Continuation of Ser. No. 699,989, Jun. 25, 1976, abandoned.

[30] Foreign Application Priority Data

Jul. 29, 1975 [DE] Fed. Rep. of Germany ..... 2533822

[51] Int. Cl.[2] ..... C25B 11/12; C25D 13/04

[52] U.S. Cl. ..... 204/294; 204/181 C

[58] Field of Search ..... 204/181 C, 294

[56] References Cited

U.S. PATENT DOCUMENTS 3,507,773 4/1970 Grangaard ..... 204/294

FOREIGN PATENT DOCUMENTS 1227405 4/1971 United Kingdom ..... 204/294

398698 12/1974 U.S.S.R. ..... 204/294

*Primary Examiner*—Howard S. Williams

*Attorney, Agent, or Firm*—Keil & Witherspoon

[57] ABSTRACT

An anode for cationic electrocoating, which consists of from 30 to 95% of graphite and from 70 to 5% of a plastic. It can be used for the electrocoating of metallic substrates.

5 Claims, No Drawings

ANODE FOR CATHODIC ELECTROCOATING

This is a continuation of application Ser. No. 699,989 filed June 25, 1976, now abandoned.

The present invention relates to an anode for cathodic electrocoating, and to a process for electrocoating metallic substrates using such an anode.

Electrocoating is a proven process for coating metallic substrates, eg. automotive steel panels. In cathodic electrocoating, a cationic binder is used, which is precipitated together with the pigment onto the panel which is made the cathode. The counter-electrodes used hitherto were almost exclusively graphite anodes. Graphite anodes are in general manufactured by compression sintering at about 2,000° C. This is a troublesome and expensive process. Such anodes also have comparatively poor strength, and cannot be drilled, cut or milled fully satisfactorily. Furthermore they are rather porous, which can lead to difficulties in sustained operation of the electrocoating baths.

It is an object of the present invention to provide anodes which can be manufactured simply and inexpensively and do not suffer from the above mechanical disadvantages, but which in respect of their suitability for electrocoating are at least equivalent to conventional graphite electrodes.

We have found that this object is achieved by providing anodes which consist of a mixture of (A) from 30 to 95% by weight of graphite and (B) from 70 to 5% by weight of a plastic.

The anodes preferably contain from 50 to 90% by weight of graphite. All conventional grades of graphite may be used, natural graphite being particularly suitable. The graphite can, in the conventional way, be employed in the form of powder, granules, platelets or flakes.

Plastics B which can be used are polymers, polycondensates and polyadducts, preferably thermoplastics which soften at from 50° to 250° C. and are moldable at these temperatures without decomposing. It is advantageous to use plastics which are resistant to oxidation and to hydrolysis.

Examples of particularly suitable plastics are homopolymers and copolymers of ethylenically unsaturated organic compounds, such as olefin polymers, eg. polyethylene or polypropylene, styrene polymers, eg. polystyrene or high-impact polystyrene, polymers containing chlorine, eg. polyvinyl chloride, polyvinylidene chloride or chlorinated polyolefins, and also polymethyl methacrylate and polyacrylate. It is also possible to use polycondensates or polyadducts, eg. nylon, polyesters of aromatic dicarboxylic acids and saturated diols, polycarbonates and polyacetals. Mixtures of the above plastics may, of course, also be used.

The anodes may be manufactured very simply, for example as follows: the solid, finely divided starting materials are mixed, the mixture is heated at from 100° to 300° C., preferably from 150° to 250° C., advantageously in an extruder, and a homogeneous mixture is thus obtained. This mixture can now be extruded from the extruder, cooled and granulated, and the granules can be compression-molded in any desired molds at from 100° to 300° C., using pressures of from 10 to 400 kg/cm$^2$ and residence times of from 2 to 40 minutes. It is also possible to press the well-dispersed mixture of the starting materials, whilst it is still hot after extrusion, between endless belts so as to convert it directly to the desired shape.

Sheets and bars which are from 0.3 to 30 mm thick and from 30 cm to 5 m long are preferred. In general, the electrical conductance of the materials is from 0.1 to 10 mho/cm; their strength, measured according to DIN 53,455, is preferably from 50 to 300 kp/cm$^2$. They can easily be machined, eg. by cutting, milling and drillng, which is of advantage in preparing them for the special requirements of the particular electrocoating bath. Furthermore they have a smooth, non-porous surface.

The process of electrocoating is well known; the substrate to be coated, which is made the cathode, as well as an anode are dipped into an aqueous bath which contains a binder, a pigment and optionally the conventional additives, the cathode and anode being connected by a circuit. The voltage applied is, as usual, from 50 to 500, preferably from 100 to 400, and the solids content of the bath is from 5 to 20% by weight, preferably from 10 to 15% by weight. The weight ratio of binder to pigment can vary from 1:0.1 to 1:0.4; the pH of the bath is from 4 to 9, preferably from 5 to 8.5. The cationic binders used contain positively charged groups, eg. quaternary ammonium groups or sulfonium groups. It is possible to use, eg., acrylic ester polymers which contain alkylamino groups (German Published Applications DAS Nos. 1,546,840 and 1,546,848) or imidazole groups (German Published Application DAS No. 1,276,260). Mixtures of polyfunctional aminoalcohols having a tertiary nitrogen atom, a long-chain monocarboxylic acid, a polycarboxylic acid and a phenoplast resin or aminoplast resin in accordance with German Laid-Open Application DOS No. 1,930,949 may also be used. Epoxy resins based on reaction products of a polyepoxide and a secondary or tertiary amine containing hydroxyl groups, according to German Laid-Open Application DOS No. 2,033,770, and mixtures of organic binders containing amino groups and blocked polyisocyanates, according to German Laid-Open Application DOS No. 2,057,799, may also be employed. Reaction products of epoxy resins with Mannich bases obtained from condensed phenols, a secondary amine which carries a hydroxyalkyl group, and formaldehyde, in accordance with German Laid-Open Applications DOS Nos. 2,320,301 and 2,357,075, are also very suitable.

In addition to the binder and pigment, the electrocoating baths may contain the conventional additives, eg. fillers, solvents, flow control agents, dispersing assistants, stabilizers, anti-foam agents and baking catalysts.

In the Examples, parts and percentages are by weight.

EXAMPLE 1

(a) Manufacture of an electrode

An 0.6 cm thick and 30 cm wide sheet of a mixture of 30 parts of polypropylene (density 0.908 g/cm$^2$; melt index about 2.5 g/10 minutes) and 70 parts of graphite flakes was extruded at 250° C. The plastic mixture was compressed by means of endless steel belts in a pressure zone, under a pressure of about 5 bars, the residence time in the pressure zone being about 2 minutes. The finished continuous sheet leaves the pressure zone via cooled rollers; it is 4 mm thick. It is then cut to the desired lengths of sheet. The electrical conductance of the sheets is 0.5 mho/cm. The strength of the sheets was measured in accordance with DIN 53,455. It is 200 kp/cm². TheE-modulus, according to DIN 53,457, is 15,300 N/mm².

(b) Electrocoating

A bath of 6 liters of a cationic electropaint comprising the binder of German Laid-Open Application DOS No. 1,930,949, Example 1, pigmented with red iron oxide (Binder:pigment ratio = 1:0.2) is provided with the electrode manufactured according to a). The surface exposed to the bath is about 150 cm². Coatings which, in respect of their quality, do not differ from those of Example 1 of German Published Application No. 1,930,949, are deposited on untreated steel sheets in this coating bath, in the course of 2 minutes at 30° C., a pH of 4.5 and a voltage of from 170 to 180, without the use of a series resistor.

EXAMPLE 2

20 parts of polypropylene and 80 parts of graphite are processed as described in Example 1, to give sheets. The electrical conductance of these is 3.5 mho/cm, the strength is 150 kp/cm² and the E-modulus is 30,000 N/mm².

EXAMPLE 3

(a) Manufacture of an electrode 20 parts of an ethylene polymer (density 0.96 g/cm³), melt index 4,5 g/10 minutes) and 80 parts of graphite are processed as described in Example 1, to give sheets. The electrical conductance of these is 0.4 mho/cm, the strength is 85 kg/cm² and the E-modulus is 7,200 N/mm².

(b) Electrocoating 6 liters of a cationic electrocoating bath as described in Example 3 of German Pat. No. 2,357,075 are provided with the electrode manufactured according to 3a). The surface exposed to the bath is about 150 cm². Coatings are deposited on phosphatized steel sheets in this coating bath in the course of 2 minutes at 30° C., a pH of 8.6 and a voltage of 280, without the use of a series resistor.

We claim:

1. A process for producing an anode for the electrocoating of metallic substrates in which the substrate, which has been made the cathode, and the anode are dipped into an aqueous bath which contains a heat-curable cationic organic binder, pigments and further additives, wherein the anode consists of a mixture of (A) 50 to 90% by weight of natural graphite and (B) from 50 to 10% by weight of homo- or copolymers of ethylenically unsaturated organic compounds, which process comprises:

(1) mixing finely divided components (A) and (B) in an extruder, (2) heating this mixture to a temperature of from 100° to 300° C., (3) extruding the mixture, (4) cooling and granulating the extrudate, and (5) compression-molding the granules to form the anode.

2. A process for metallic substrates as claimed in claim 1, wherein the component B is a homopolymer or copolymer of an ethylenically unsaturated organic compound which softens, and is moldable, at from 50° to 250° C., without decomposing.

3. A process for producing an anode for the electrocoating of metallic substrates as claimed in claim 1, wherein the anode has an electrical conductance of from 0.1 to 10 mho/cm.

4. A process for producing an anode for the electrocoating of metallic substrates as claimed in claim 1, wherein the anode has a strength, measured according to DIN 53,455, of from 50 to 300 kp/cm².

5. A process for producing an anode for the electrocoating of metallic substrates as claimed in claim 1, wherein an anode in the form of a sheet or bar which is from 0.3 to 30 mm thick and from 30 cm to 5 m long is used.

* * * * *